United States Patent [19]

Uhl et al.

[11] 4,218,971

[45] Aug. 26, 1980

[54] SEGMENTED CHARACTER ACTUATION SYSTEM FOR ROTATING PRINT WHEEL

[75] Inventors: Robert J. Uhl, Wayne; Alexander A. Schwarz, Ogdensburg, both of N.J.

[73] Assignee: Dennison Manufacturing Company, Framingham, Mass.

[21] Appl. No.: 900,847

[22] Filed: Apr. 28, 1978

[51] Int. Cl.[3] ..... B41F 17/26

[52] U.S. Cl. ..... 101/35; 101/93.04; 101/91; 400/125; 400/181

[58] Field of Search ..... 400/125, 125.1, 179, 400/181; 101/93.1, 93.04, 35-37, 91, 92, 102, 35

[56] References Cited

U.S. PATENT DOCUMENTS

| | | | |
|---|---|---|---|
| 2,715,360 | 8/1955 | Brown, Jr. | 101/92 |
| 3,112,693 | 12/1963 | Williams | 101/102 |
| 3,138,092 | 6/1964 | Block | 101/91 |
| 3,769,906 | 11/1973 | Martin | 101/91 |
| 3,994,217 | 11/1976 | Archila | 101/35 |
| 4,028,537 | 6/1977 | Snow | 101/35 X |

*Primary Examiner*—Clifford D. Crowder
*Attorney, Agent, or Firm*—George E. Kersey

[57] ABSTRACT

Method and apparatus for random segment imprinting of alphanumerical designations and other symbols on cartons, cases, and the like. The imprinter includes a control logic module, a rotating print cylinder, and an ink cartridge. It permits rapid automatic substitution of designations without interrupting the printing process.

8 Claims, 6 Drawing Figures

SEGMENTED CHARACTER ACTUATION SYSTEM FOR ROTATING PRINT WHEEL

BACKGROUND OF THE INVENTION

The invention relates to imprinting, and, more particularly to the imprinting of cartons and the like with prescribed alphanumerical designations and other symbols.

Cartons, cases, and the like are imprinted with alphanumerical designations to indicate weights, contents, and other information. Printing is effected by use of a stamp coated with ink. The stamp is impressed by hand or by use of a rotary wheel against the item to be imprinted.

To change a numerical code or other symbol, the printing process is halted until the stamp is manually replaced with another. Unless all cartons are to be imprinted with the same code, the printing process must be halted until the stamp is replaced before cartons requiring a different code may be imprinted. Merger on the same conveyor of cartons requiring different codes, as where coding takes place by weight, therefore results in costly delays due to continual halting of the printing process, making such merger impracticable.

Codes can be changed without halting the printing process by use of control jet or video jet systems, which can be preprogrammed to print selected codes. These systems are extremely complex, however, and are capable of printing figures of up to only ¼ of an inch in height.

Accordingly, it is an object of the invention to achieve rapid automatic change of alphanumerical codes and other symbols without interrupting the printing process. A related object is to achieve rapid change of codes without the need for manual replacement of stamps. A general object of the invention is to avoid costly delays in the printing process.

A further object of the invention is to avoid the necessity at each coding station of imprinting only cartons requiring the same code. A related object is to permit continuous imprinting of cartons, each requiring a different code.

A still further object is to achieve rapid automatic change of codes without the use of control jet or video jet systems. A related object is to effect such rapid automatic change of codes without the need for complex systems. Another related object is to avoid limitation of print size.

SUMMARY OF THE INVENTION

In accomplishing the foregoing and related objects, the random segment coder of the present invention is comprised of a control logic module, a rotating print cylinder with a stationary core, an ink cartridge, and a backup rail.

In accordance with one aspect of the invention, the random segment imprinter includes a control logic module which transmits pre-programmed impulses to solenoid valves located within a stationary core of the rotating print cylinder. Each solenoid valve activates a segment of a given symbol in the rotating print cylinder.

In accordance with another aspect of the invention, the rotating print cylinder contacts a stationary ink cartridge, coating the activated segments with ink. The rotating print cylinder prints a code on a carton, case, or the like, which is carried between the rotating print cylinder and a backup rail by a conveyor. Printing occurs when the carton is pressed by the backup rail against the ink-coated activated segments on the rotating print cylinder.

In accordance with a further aspect of the invention, the code may be changed by resetting the activated segments to their original position and programming a new code into the control logic module.

DESCRIPTION OF THE DRAWINGS

In accordance with a preferred embodiment of the random signment imprinter of the invention.

DETAILED DESCRIPTION

Reference should now be had to the FIGS. 1 through 5 for a detailed description of the invention.

Figure 1:
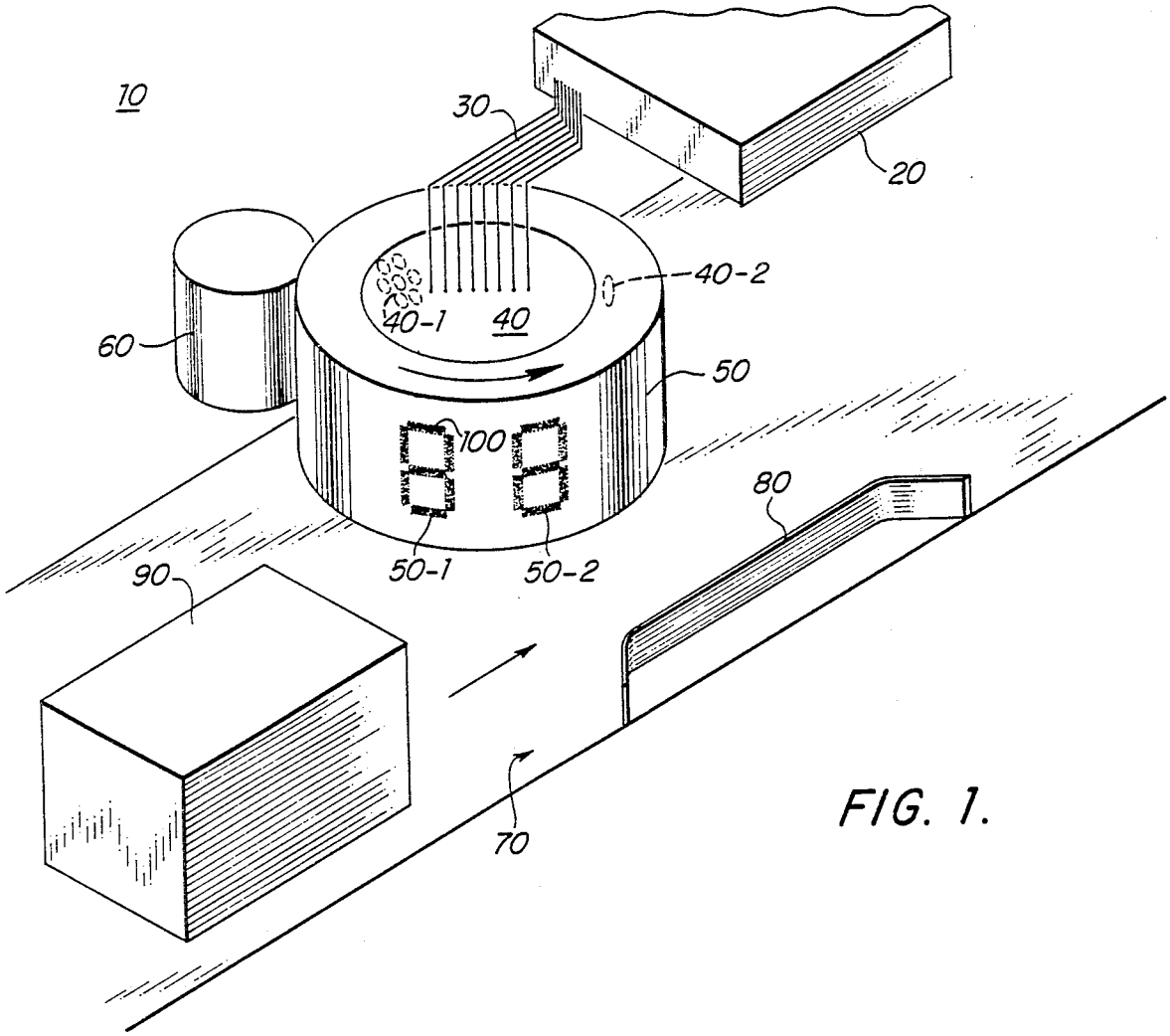
FIG. 1 is a front view of the random segment imprinter of the invention

The random segment imprinter is shown at 10 in FIG. 1 in an embodiment for imprinting of numerical codes, and is comprised of a control logic module 20, eight input signal wires 30, a stationary core 40, a rotating print cylinder 50, an ink cartridge 60, a conveyor 70, and a backup rail 80.

As a carton 90 proceeds along the conveyor 70, the desired coding information is formulated by an operator and is submitted to the control logic module 20. A decade or binary coded decimal signal is translated by the control logic module 20 into a seven segment code and is transmitted and amplified through wires 30 by driver stages (not shown) to solenoid valves (not shown) located within the stationary core 40. Each activated solenoid valve opens to permit air to penetrate a hole 40-1 in the wall of the stationary core 40. The air then passes through a corresponding hole (not shown) in the inner wall of the rotating print cylinder 50 to activate a segment 100 of a digit 50-1 located on the rotating print cylinder 50. Each activated segment 100 is coated with ink by the ink cartridge 60, as the rotating print cylinder 50 rotates counter-clockwise past the ink cartridge 60. Printing occurs when each activated segment 100 of each digit 50-1 on the rotating print cylinder 50 is pressed against the carton 90. This pressure results when the carton 90, passing along the conveyor 70, is forced against the rotating print cylinder 50 by the backup rail 80.

The stationary core 40 includes eight solenoid valves (not shown), each connected individually by a single wire 30 to the control logic module 20. The control module 20 is activated by an external input signal of 5 volts DC with a rise time of 1 millisecond. Correspondingly, the controlmodule 20 transmits an activating signal to appropriate solenoid valves which open for a fraction of a second (except for the eighth solenoid valve, which performs a similar function in resetting the apparatus) to permit filtered air under a representative pressure of 60 to 120 PSI to pass through one of the seven holes 40-1 in the stationary core 40 wall. Each solenoid valve controls the flow of air through a single hole in the stationary core wall. The solenoid valves may also be located within the control logic module 20, in which case air would be translated from the control logic module to the holes 40-1 along the input signal paths 30. An eighth air hole, 40-2, in the stationary core 40 wall is used in resetting the digits, as discussed below.

The rotating print cylinder 80 illustratively is 12 inches in diameter and comprises up to 18 digits (two of which are designated in FIG. 1 as 50-1 and 50-2). An inner wall of the rotating print cylinder 50 contains eight air holes (not shown) for each digit, as each segment 100 of each digit 50-1 has its hole, the eighth air hole being used to reset all the segments of a digit.

Figure 2:
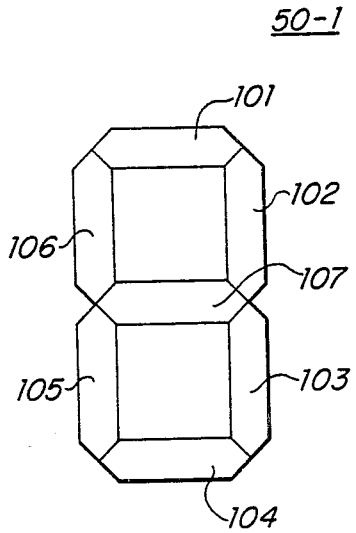
FIG. 2 is an illustration of a printed digit.

A digit 50-1, illustrated in FIG. 2, desirably may be up to 2 inches high and 1 inch in width and is composed of 7 segments 101 through 107. If all 7 segments 101 through 107 are activated, for example, the digit will print the figure 8. If segments 101, 102, and 103 are activated, the digit will print the figure 7. Although a seven segment code is used for convenience, a larger number could be used for more flexibility. More generally, the inclusion of additional segments would make possible the imprinting of alphabetical designations and other symbols. Although the printing of decimal digits is assumed for illustrative purposes herein, it is not intended that the scope of the invention be thereby limited.

Figure 4:
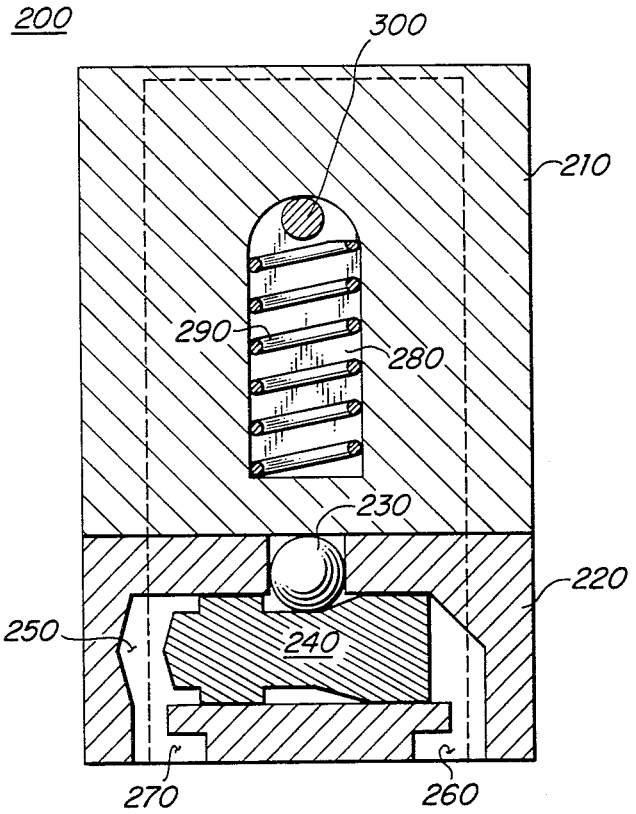
FIG. 4 is a cutaway side view of a segment assembly, in a section along the lines 4—4 of FIG. 3.

A segment assembly as shown at 200 in FIG. 4 is comprised of a sliding segment 210, a segment housing 220 (partially visible in this view), a ball 230, a poppet 240, a clearance region 250, an activating air hole 260, a reset air hole 270, a slot 280 in the sliding segment, a compression spring 290, and a pin 300. Illustratively, the sliding segment 210, ball 230, and poppet 240 are composed of hardened steel, the housing 220 of brass. To activate the sliding segment 210, air released by a solenoid valve located in the stationary core 40 passes through a hole 40-1 in the stationary core wall, and thence through a corresponding hole (not shown) in the inner wall of the rotating print cylinder where it penetrates the clearance region 250 via the actuating air hole 260. Poppet 240 is thereby displaced to the left, and the incline of the poppet forces ball 230 up against the segment 210, raising it into its activated position 1 to 3 mm (depending on design requirements) above the outer wall of the rotating print cylinder 50.

The segment 210 will remain activated until air released by a solenoid valve located in the stationary core 40 penetrates the clearance region 250 through the reset air hole 270, forcing the poppet 240 back to its original position. The ball 230 will drop and the segment 210 will resume its pre-activated position. This is due to the pressure exerted by the compression spring 290 between the bottom of the segment 210 and the pin 300. The spring 290 rests freely in a slot 280 in the segment 210, and the pin 300 passes through the slot 280 and is anchored to the housing 220.

Figure 3:
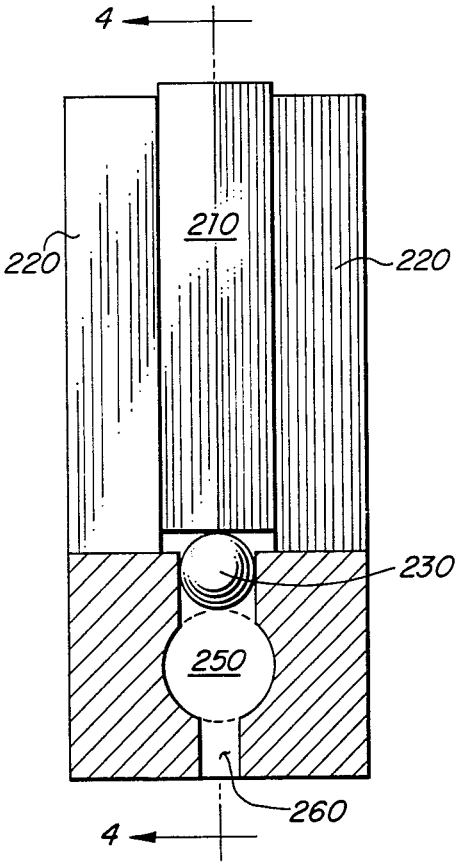
FIG. 3 is a partially cutaway view of a segment assembly, as seen from the end.

The geometry of the segment assembly 220 may best be understood by comparing it in different views. FIG. 3 shows an end view of the segment assembly, partially cut away. This shows the sliding segment 210 sandwiched between the two walls of the housing 220. Below, in section, can be seen the ball 230, the clearance region 250, and activating air hole 260. The side view of FIG. 4, discussed above, represents a section taken through the vertical center line of FIG. 3. The dotted line in FIG. 4 represents the outer border of the interface between the sliding segment 210 and the segment housing 220 (only the lower part of which is shown in this cutaway side view).

Figure 5:
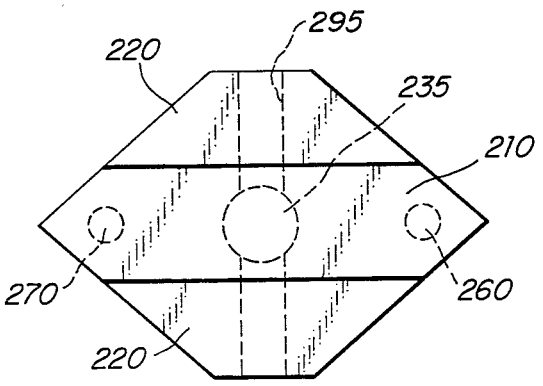
FIG. 5 is a top view of a segment assembly.

FIG. 5 shows the segment assembly 200 as seen from the top, again showing the segment 210 placed between the housing walls 220. The various dotted outlines show the locations of the activating and reset air holes, 260 and 270, the hole 235 through which passes the ball 230, and the shaft 305 in which rests the pin 300. This view may be compared with the digit shown in FIG. 2 to illustrate how seven of the segment assemblies 200 may be juxtaposed in the wall of the rotating print cylinder 50 to make possible the printing of desired digits.

The segment assembly 200 is constructed in a several step process. The poppet 240 is inserted through a hole (not shown) in the end of the housing 220 (seen in the view of FIG. 3), into the clearance region 250. A plug (not shown) is then used to close the hole. The metal ball 230 is dropped between the walls of the housing 220, into the hole 235. The spring 290 is fit into the slot 280 of segment 210, after which the segment is slipped between the confining walls of the housing 220, on top of the ball 230. The pin 300 is partially inserted into the hole 295 in one wall of housing 220, and the spring 290 is compressed by means of a screwdriver which is wielded through an access hole (not shown). While the spring is compressed, the pin is pushed through the top of the slot 280 and into the hole in the other wall of the housing 220. The segment assembly 200 is then ready to be incorporated in the rotating print cylinder 50.

Figure 6:
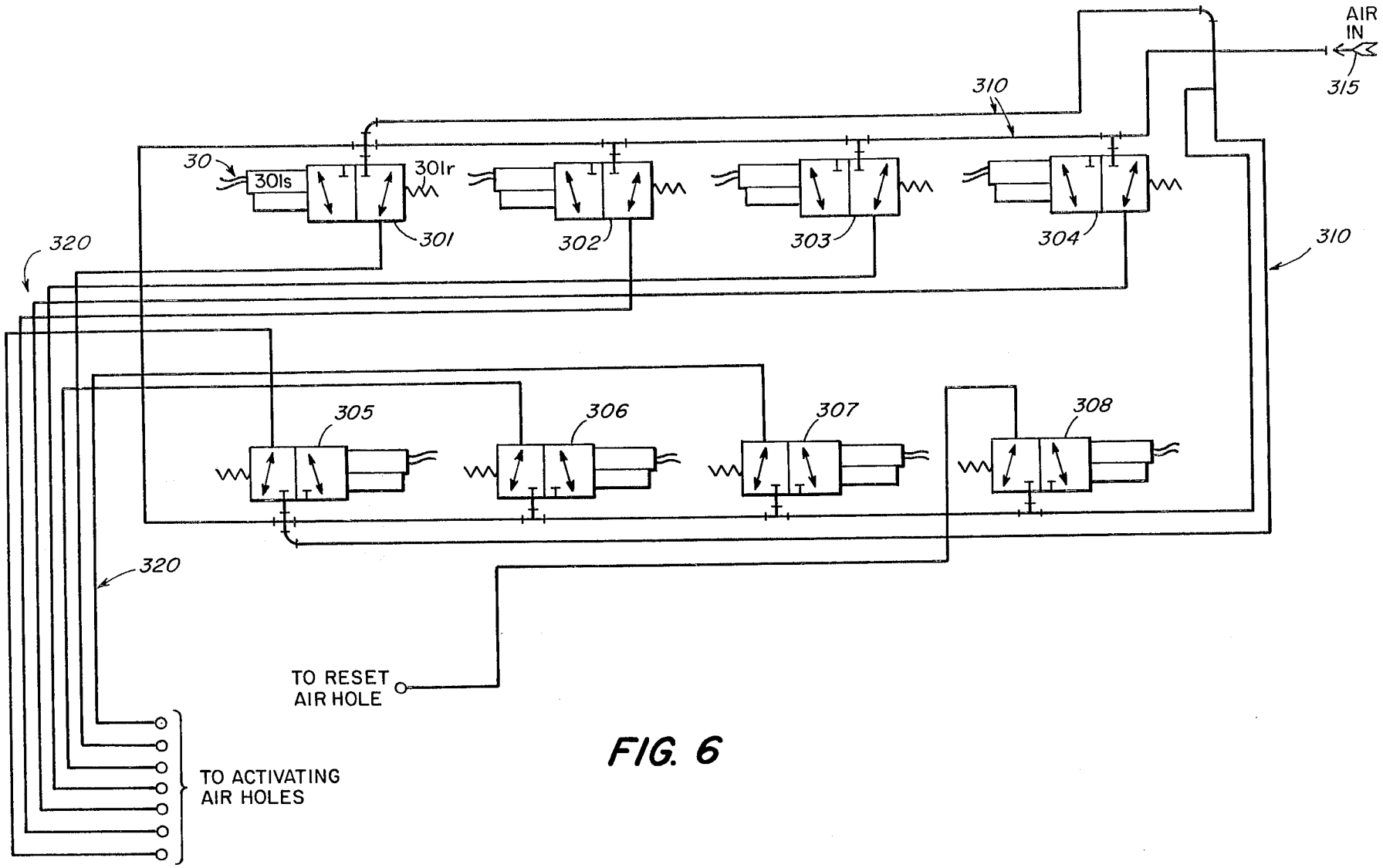
FIG. 6 is a schematic view of solenoid valves and associated air lines in accordance with a preferred embodiment of the invention.

FIG. 6 is a schematic view of solenoid valves housed in stationary core 40, including pneumatic connections. Eight solenoid valves 301–308 are shown in an inactive state. Each is shown connected to an input wire 30 from control module 20; alternatively, solenoid valves 301–308 may be contained within control module 20. The solenoid valves receive high pressure air from source 315 through input air lines 310. When a given solenoid valve 301 receives an actuating signal from the associated control wire 30, solenoid 301S is energized causing the valve to open and allow the output of high pressure air through one of output air lines 320. Compression spring 301R exerts a countervailing force closing the valve in the absence of an actuating signal. High pressure air from solenoid valves 301–307 is routed to the activating air holes 260 of segments to be raised, while high pressure air from valve 308 is routed to the reset air holes 270. Ducting apparatus for directing the high pressure air from the solenoid valves to the ports 40-1 and 40-2 in the outer wall of the stationary core, and from the ports in the inner surface of the rotating print cylinder to the air holes of individual segments, may be of any conventional design well known to skilled practitioners of the art.

To set the programmed numerical code, digit 50-1 on the rotating print cylinder 50 is rotated to a position opposite the air holes 40-1 on the stationary core 40 wall. The appropriate solenoid valves (not shown) will be opened to permit air to activate the desired segments of digit 50-1 to form the programmed figure. After the appropriate segments 100 on digit 50-1 are activated, the rotating print cylinder 50 will rotate digit 50-2 to a position opposite the air holes 40-1 in the stationary core 40 wall. Digit 50-2 is illustratively separated from digit 50-1 by a space of 1 inch. The appropriate segments 100 of digit 50-2 will be activated to form the programmed figure, as before. Activation of the segments 100 of each digit will occur in like manner until all of the programmed figures have been formed.

After the ink coating and printing processes have occurred during additional rotation of the print cylinder, a reset pulse will retract all segments of all digits. If this reset pulse is omitted, however, the code will be repeated continuously until the reset pulse is injected. Reset of the segments occurs much as does segment activation. Each digit rotates to a position opposite a reset hole 40-2 in the stationary core 40 wall. High pressure air passes through the reset hole 40-2 and a corresponding hole (not shown) in the rotating print cylinder 50 wall, where it is conducted through a manifold (not shown) into the reset air holes of all seven segments.

Advantageously, the rotating print cylinder 50 rotates once every 2 seconds. Up to thirty cartons 90 may be imprinted per minute. Each carton 90 may be up to thirty-five inches long. In an alternative embodiment, two sets of digits are included in the perimeter of the rotating print cylinder 50, enabling the operator to imprint two cartons per rotation. In this embodiment, up to sixty cartons may be imprinted per minute, and each carton may be up to seventeen inches long. A programmed code may be replaced by another code without halting or slowing the printing process.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Apparatus for the imprinting of alphanumerical designations and other symbols in cases, cartons, and the like comprising:

a control logic module which is programmable with desired designations;

a rotating print cylinder having a number of perimetric symbols composed of a given number of projectible segments, said cylinder having a stationary core;

means for transmitting a control signal from said control logic module to said stationary core, and for converting electrical impulses corresponding to the programmed numerical designations into a form suitable for activating a selected set of said segments;

means responsive to said converted electrical impulses for activating said selected segments to cause them to project from the perimeter of the rotating print cylinder, wherein each of said selected segments with its activating means constitutes a self-contained unit;

a cartridge for coating said selected segments with ink;

means for bringing objects to be imprinted into contact with the ink coated selected segments; and means responsive to said converted electrical impulses for resetting said selected segments whereby a new set of segments may be activated, wherein each of said selected segments with its resetting means constitutes a self-contained unit.

2. The apparatus as defined in claim 1 wherein the transmitting and converting means comprises:

wires running from said control logic module to the stationary core of said rotating print cylinder, said wires numbering one more than the number of segments per symbol;

solenoid valves housed within said stationary core, each of which is connected to one of said wires, to allow high pressure air to pass through an aperture in the outer wall of said stationary core upon reception of an electrical impulse.

3. Apparatus as defined in claim 2 wherein the means for activating the selected segments comprises:

a segment housing including a slot in which a segment is slidably mounted, a clearance region having activated and reset ends, an input air hole communicating with the clearance region at its reset end, and a bore connecting said clearance region to said slot;

a poppet movable between the activated and reset ends of the clearance region; and a ball resting in said bore on an inclined surface of said poppet;

wherein the admission of high pressure air through the input air hole forces the poppet toward the activated end of the clearance region, thereby urging the ball against the segment and causing the segment to protrude from the segment housing.

4. Apparatus as defined in claim 3 wherein said segment housing further includes a reset air hole communicating with the activated end of said clearance region, and wherein the resetting means is comprised of a compression spring which is located between said segment and a pin anchored to said housing, and which exerts pressure on said segment contrary to that exerted by said ball, whereby the flow of high pressure air from said solenoid valve forces said poppet toward the reset end of the clearance region, thereby releasing the ball and allowing the segment to assume a retracted position.

5. The apparatus as defined in claim 1 wherein the transmitting and converting means is comprised of:

solenoid valves located within said control logic module numbering one more than the number of segments per symbol;

for each solenoid valve, an air line running from said solenoid valve to an aperture in the outer wall of the stationary core of said rotating print cylinder.

6. The apparatus as defined in claim 1 wherein the control logic module receives a decimal or digital signal from an operator of the imprinting apparatus and translates said signal to a code having components equal in number to the number of segments per symbol.

7. The method of imprinting pre-programmed alphanumerical designations and other symbols on cases, cartons, and the like which comprises the steps of:

(a) programming a control logic module with desired designations, (b) transmitting electrical impulses corresponding to the programmed designations from said control logic module to a stationary core of a rotating print cylinder having a number of symbols on its perimeter, which symbols are composed of a given number of projectible segments, (c) converting said electrical impulses into a form suitable for activating a set of selected segments, (d) activating said selected segments by means associated with the individual segments, whereby these segments project from the perimeter of the rotating print cylinder, (e) coating said selected segments with ink by rotation past an ink cartridge, (f) bringing objects to be imprinted into contact with the ink-coated selected segments, and (g) resetting said selected segments by means associated with the individual segments.

8. The method of imprinting alphanumerical designations and other symbols on cases, cartons, and the like which comprise the steps of:

(a) programming a control logic module with desired designations, (b) converting electrical impulses corresponding to the programmed designations into a form suitable for activating a set of selected projectible segments, which segments are component parts of symbols on the perimeter of a rotating print cylinder with stationary core, (c) transmitting the electrical impulses in converted form from said control logic module to said stationary core, (d) activating said selected segments by means associated with the individual segments, whereby these segments project from the perimeter of the rotating print cylinder, (e) coating said selected segments with ink by rotation past an ink cartridge, (f) bringing objects to be imprinted into contact with the ink-coated selected segments, and (g) resetting said selected segments by means associated with the individual segments.

* * * * *